United States Patent [19]

Raible

[11] Patent Number: 4,955,534

[45] Date of Patent: Sep. 11, 1990

[54] SWIVEL MAIL BOX

[76] Inventor: Fred A. Raible, 10283 Kasubowski Rd., Posen, Mich. 49776

[21] Appl. No.: 350,752

[22] Filed: May 11, 1989

[51] Int. Cl.[5] ..... B65D 91/00

[52] U.S. Cl. ..... 232/39; 248/145

[58] Field of Search ..... 232/39; 248/145, 418, 248/415, 417

[56] References Cited

U.S. PATENT DOCUMENTS

| | | | |
|---|---|---|---|
| 2,216,408 | 10/1940 | Elmer | 248/145 |
| 4,130,239 | 9/1977 | Belsheim . | |
| 4,187,978 | 2/1980 | Dowker | 248/145 X |
| 4,667,918 | 7/1985 | Page . | |

*Primary Examiner*—Robert W. Gibson, Jr.

[57] ABSTRACT

The present invention relates to a mailbox mounting device that can swing about its support. Which it is mounted, which is less subject to damage due to impact from wet snow being plowed or other motor vehicles moving along the roadway. The device is composed of steel and wood laminated together to form one solid swivelable member and within its formed body a shearable pin is located. Held to a base plate by a bolt or pin, allowing the four flat surfaces to act as pivot plates when the shear pin has been broken with a predetermined force then the movement, in a horizontal plane, will take place.

2 Claims, 2 Drawing Sheets

SWIVEL MAIL BOX

SUMMARY OF THE INVENTION

This invention seeks to solve the problem with a different aproach. The mailbox support is a composition of light steel and wood laminated to a flat plate. A hole is located to the rear of said plate for a shear pin. The mounting post has a base plate secured to its top. This base plate is flat on top and extends down on opposite sides of the post. At the top portion it extends past the post for the shear pin at this point the "L" shaped base plate reinforcement shear pin holder is positioned. Held together by a bolt or pin extending down throught the laminated parts into the base plate throught the bolt stabilizing plate and washer then fastened. The shear pin holds the swivel plate solid, but will break on impact, allowing the laminated portion to swivel out of the way. Then the mailbox can be repositioned and a new shear pin can be replaced. The base plate and base plate reinforcement sheer pin holder, holds the shear pin solid when the base plate reinforcement shear pin holder is installed. It reinforces the base plate and also allows the broken shear pin to fall free of moving parts. And if a home owner decides a rigid mount is what he or she wants a bolt can be easily installed where the shear pin in located.

BACKGROUND OF THE INVENTION

The invention relates to rural mailboxes and their mounting devices. A problem has existed for a long time because damage done by snowplows and other vehicles is very costly and there is a need for a low cost, easily replaceable, mailbox that would have a swing-mounting device and give on impact.

DETAILED DESCRIPTION OF THE PREFERRED EMBODIMENT

Figure 1:
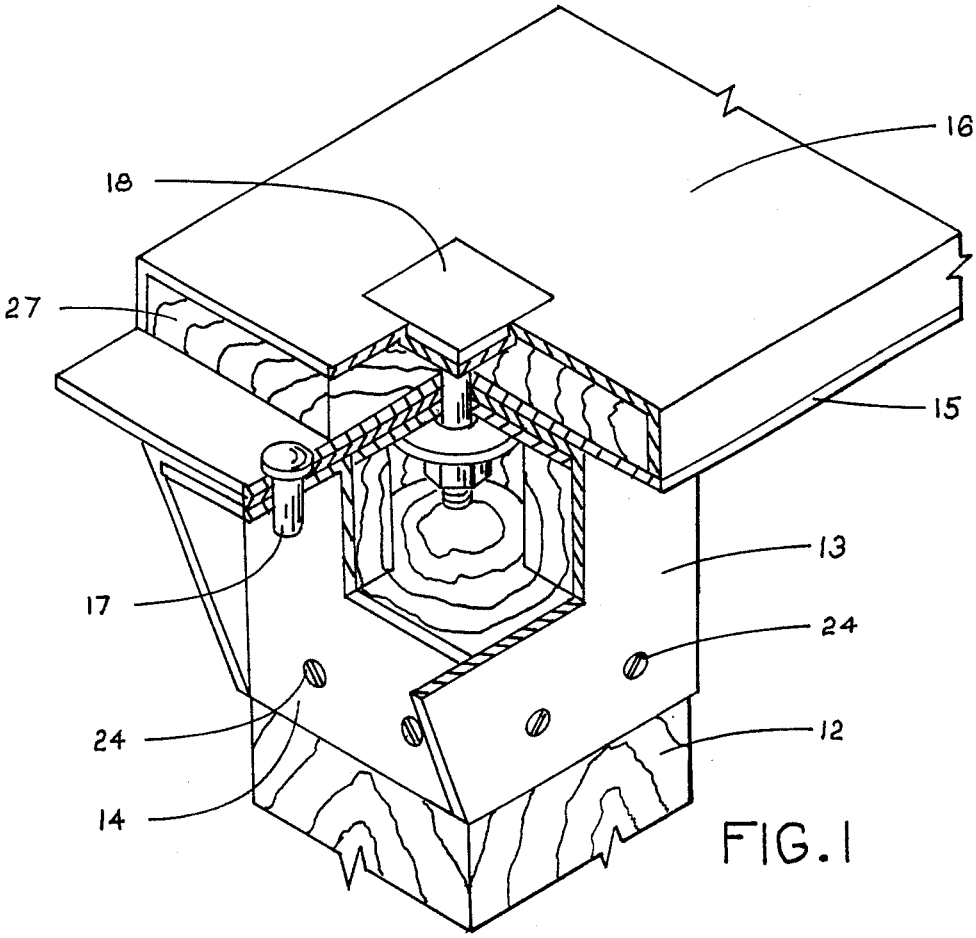
FIG. 1 is a broken out section view of the swivelable laminated parts held in a locked configuration by a shearable pin.
Figure 2:
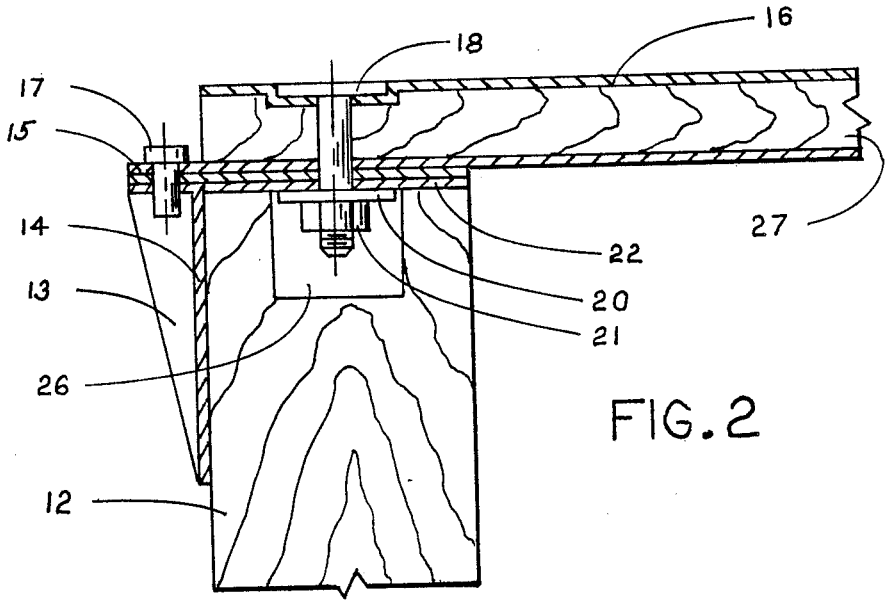
FIG. 2 is a full section showing the placement of the affixed bolt or pin to the laminated parts and the washer being held tight to the stabilizing plate by an affixed nut.
Figure 3:
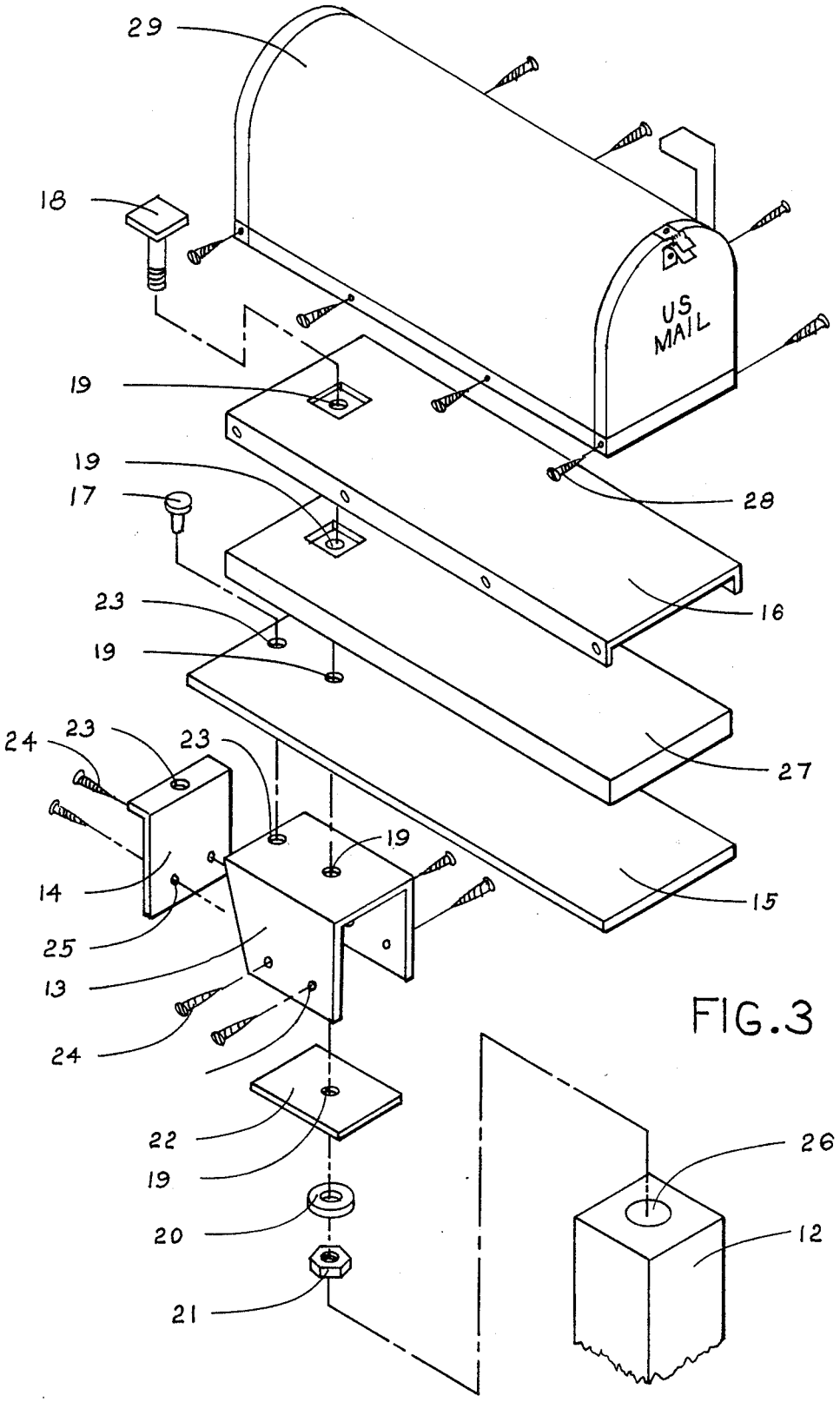
FIG. 3 is an exploded view showing the separation of all parts before assembly.

Objects and advantages will be readily apparent from the following detailed description and drawing in which FIG. 1 shows a square post 12, for mounting this swivelable apparatus. The post 12, can be square or rectangular in shape. The base plate 13, shown in FIG. 1. and FIG. 3, is flat on top and extends down on two opposite sides of its mounting post. FIG. 3 shows the two sides of the base plate, a series of holes 25 are located so that wood screws 24 can be inserted horizontally, installing them this way gives greater strength and holding ability to the base plate 13.

The base plate 13 extends past the post 12 on top as viewed in FIG. 1. For a shear pin hole 23 and another hole 19 is located in the center for the main bolt 18 as viewed in FIG. 3. At the back side of said base plate 13 a formed a bracket called the base plate reinforcement shear pin holder 14 is installed into the projecting portion of said base plate 13. The L shape bracket with a 90 degree bend at its top has a shear pin hole 23 as viewed in FIG. 3 and lines up with the shear pin hole 23 in the base plate 13. It also is fastened to the back of the supporting post 12 with wood screws 24. The laminated swivel plate 15 is formed with wood 27 and steel 16 making the swivel plate 15 one solid piece. It also projects past the post, 12 the base plate, 13 and laminated swivel plate 15. Both have a bolt hole 19. The bolt hole, 19 in the base plate 13 is in the center, and the bolt hole 19 in the laminated swivel plate 15 is located in the laminated rear portion. Plate 15 also projects past its laminated part of steel 16 and wood 27 and within its body has a shear pin hole 23. As viewed in FIG. 1 these holes 23 are aligned for a shear pin 17. Holes 19 are also alligned so that the bolt 18 may pass through the steel 16, wood 27, swivel plate 15, base plate 13 and into the bolt stabilizing plate 22. The bolt stabilizing plate 22 fits under the base plate 13 and tight to the base plate reinforcement and shear pin holder 14 giving strength to the base plate 13 and giving more surface for the bolt 18. The base plate reinformcement and shear pin holder 14 is installed into the projecting rear portion of the base plate 13 giving strength to the base plate while holding the bottom part of the shear pin, 17 so as to hold the laminated swivel plate 15 rigid. Bolt 18 is fixed solid to the steel 16, and wood 27 and the swivel plate 15 so the only movement that takes place is between the base plate 13, swivel plate 15, bolt stabilizing plate 22, and the washer 20. In the drawing, FIG. 1 shows the projection of the shear pin 17 in relationship to the post 12. When broken it falls free of moving parts and can be easily replaced. The post 12 can be square or rectangular and at its top center a hole 26 is located so that when all parts are assembled the bolt 18, washer 20, and nut 21 will be counter sunk into the post 12. When installing the mailbox 29 to the laminated parts the mailbox will only cover the laminated portion of the swivel plate 15. Securing the mailbox 29 to the laminated portion sheet metal screws 28 are used and the steel 16 covering gives a greater holding ability to the sheet metal screws 28.

What I claim is:

1. A swiveable mailbox support comprising: a horizontal base plate for mounting on the top surface of a mailbox support post, said base plate including a substantially centrally located first aperture and a second aperture offset therefrom, an elongated, laminated, flat mailbox mounting plate having front and rear portions, and having a third aperture located proximate the rear portion of said mounting plate and a fourth aperture offset therefrom, pivot means passing between said first and third apertures and a shearable pin seated within said second and fourth apertures, whereby when said support is mounted on the top of a mailbox support post said shearable pin will be broken by the application of a predetermined force to the end of the mounting plate opposite the shearable pin.

2. The mailbox support of claim 1 wherein the mounting plate comprises top and bottom elongated plates laminated to opposite sides of a flat wood board with said pivot mean being fixedly anchored in the top plate rear portion, offset therefrom said fourth aperture for a shearable pin being located in a portion of the bottom plate which extends rearwardly beyond the wood board and the top plate.

* * * * *